US006325102B1

(12) United States Patent
Misumi et al.

(10) Patent No.: US 6,325,102 B1
(45) Date of Patent: Dec. 4, 2001

(54) SERVO DRIVING PILOT-TYPE SOLENOID VALVE

(75) Inventors: Keiji Misumi; Makoto Ishikawa, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/545,457

(22) Filed: Apr. 7, 2000

(30) Foreign Application Priority Data

Apr. 27, 1999 (JP) ..... 11-120046

(51) Int. Cl.[7] ..... F15B 13/043
(52) U.S. Cl. ..... 137/625.64; 137/625.66
(58) Field of Search ..... 137/625.64, 625.66

(56) References Cited

FOREIGN PATENT DOCUMENTS 11-2357 1/1999 (JP) .

*Primary Examiner*—Gaerald A. Michalsky
(74) *Attorney, Agent, or Firm*—Oblon, Spivak, McClelland, Maier & Neustadt, P.C.

(57) ABSTRACT

A pilot-type solenoid valve capable of driving a valve member by increasing a pilot fluid pressure from a pilot valve and reliably switching valve member. The pilot-type solenoid valve includes a main valve portion having a valve member capable of sliding in a valve hole to which ports P, A, B, EA and EB in a valve body are opened, a pilot driving mechanism for applying a pilot fluid pressure to a pushing member which pushes one end of the valve member, and a returning mechanism for applying a returning force to the valve member. The pushing member includes a first piston for applying the pilot fluid pressure, and a second piston which is pushed by the first piston and which pushes the valve member. A shaft of the first piston passes through a partition wall in a sealing manner and abuts against the second piston. The shaft is provided therein with a guide hole for guiding the pilot fluid pressure to a pressure chamber of the second piston.

3 Claims, 3 Drawing Sheets

SERVO DRIVING PILOT-TYPE SOLENOID VALVE

TECHNICAL FIELD

The present invention relates to a servo driving pilot-type solenoid valve for driving a valve member by increasing an operation force by a pilot fluid pressure output from a pilot valve.

PRIOR ART

According to a pilot-type solenoid valve disclosed in Japanese Patent Application Laid-open No.H11-2357, for driving a spool valve, the spool valve is provided at its one end with a first piston to which a pilot pressure is always applied, and is provided at the other end with second and third pistons. Pilot pressure is individually applied to the second and third pistons so that both the pistons drive a spool. If the supply of the pilot pressure is stopped, the spool valve is returned by the pilot pressure which is always applied to the first piston. A responsibility of a reciprocating motion of the spool is stabilized by these pistons, and an outer appearance of the valve is thinned.

According to the pilot-type solenoid valve of such a structure, a supply/discharge path of the pilot pressure applied to each of the pistons from the pilot valve is complicated, there is no compatibility with components of general pilot-type solenoid valves and therefore, it is difficult to provide a product inexpensively.

DISCLOSURE OF THE INVENTION

The present invention has been accomplished to solve the above problem, and a technical object of the invention is to provide a servo driving pilot-type solenoid valve for driving a valve member by increasing an operation force by a pilot fluid pressure output from a pilot valve so that valve member can reliably be switched.

Another technical object of the invention is to provide a servo driving pilot-type solenoid valve in which a valve member can be driven by piston even with a low pressure, thereby increasing a driving pressure range.

Still another technical object of the invention is to provide a servo driving pilot-type solenoid valve in which compatibility with components of general pilot-type solenoid valve is increased, and the servo driving pilot-type solenoid valve is reduced in size like the general pilot-type solenoid valve.

To achieve the above objects, a servo driving pilot-type type solenoid valve of the present invention comprises: a main valve portion including a plurality of ports, a valve hole which is in communication with the ports, and a flow path switching valve member slidably inserted into the valve hole; a pilot driving mechanism including a pushing member disposed in one end of the valve member, and a pilot valve for supplying a pilot fluid to the pushing member, the pilot driving mechanism switching the valve member by the pushing member which is operated by effect of a pilot fluid pressure; and a returning mechanism for applying a returning force caused by a fluid pressure or a spring to the other end of the valve member, wherein the pushing member in the pilot driving mechanism comprises a first piston operated by the pilot fluid pressure from the pilot valve, and a second piston having substantially the same diameter as that of the first piston and operated by the pilot fluid pressure and a pushing force by the first piston, the first piston includes a shaft which air-tightly passes through a partition wall which divides both the pistons from each other and whose tip end abuts against the second piston, and a guide hole passing through the first piston and its shaft for guiding the pilot fluid pressure to a driving side pressure chamber of the second piston, and the second piston is disposed such that the second piston abuts against one end of the valve member and is operated by the operation force of the pilot fluid pressure introduced from the guide hole into a pressure chamber and by a pushing force of the first piston, thereby pushing the valve member.

In the above servo driving pilot-type solenoid valve, first and second interposition blocks can be disposed such as to be connected to each other between the pilot valve and a valve body of the main valve portion, a cylinder portion on which the first piston slides can be provided in the first interposition block located closer to the pilot valve, and the second interposition block located closer to the valve body can be provided with the partition wall through which the shaft of the first piston passes, and with a cylinder portion on which the second piston slides.

Further, an interposition block can be provided between the pilot valve and a valve body of the main valve portion, the interposition block can be provided therein with a cylinder portion on which the first piston slides and a partition wall through which the shaft of the first piston passes, and an end of the valve body of the main valve portion closer to the pilot valve can be formed with a cylinder portion on which the second piston slides.

The servo driving pilot-type solenoid valve of the above-described structure includes, as the pilot driving mechanism for pushing the valve member by the pushing member to switch the valve member, the first piston for applying the pilot fluid pressure from the pilot valve, and the second piston which is pushed by the first piston and which is also pushed by the pilot fluid pressure to push the valve member. Therefore, a force by the pilot fluid pressure output from the pilot valve is increased by these piston and the valve member can be driven, the valve member can reliably be switched and at the same time, the valve member can be driven by piston even with a low pressure, thereby increasing a driving pressure range.

In the above servo driving pilot-type solenoid valve, the first and second interposition blocks are superposed on each other between the pilot valve and the valve body, the cylinder portions on which the first and second pistons slide are provided in these interposition blocks, the pilot fluid pressure is introduced into the driving side pressure chamber of the first piston from the pilot valve, and the pilot fluid pressure is introduced into the driving side pressure chamber of the second piston through the first piston and the guide hole in its shaft. With this structure, it is possible to use components common to general pilot-type solenoid valve except the first and second interposition blocks superposed on each other between the pilot valve and the valve body as well as the first and second pistons and the like. The flow paths of the pilot valve are also common and therefore, the compatibility of the components is increased and the products can be produced inexpensively. Further, the servo driving pilot-type solenoid valve can be reduced in size like general pilot-type solenoid valve.

Further, in the above servo driving pilot-type solenoid valve, a single interposition block is provided between the pilot valve and a valve body of the main valve portion, the interposition block is provided therein with a cylinder portion on which the first piston slides, and the end of the valve body closer to the pilot valve is formed with a cylinder portion on which the second piston slides. With this structure also, compatibility with components of general pilot-type solenoid valve can be increased, and the servo driving pilot-type solenoid valve can be reduced in size like the general pilot-type solenoid valve.

DETAILED DESCRIPTION

Figure 1:
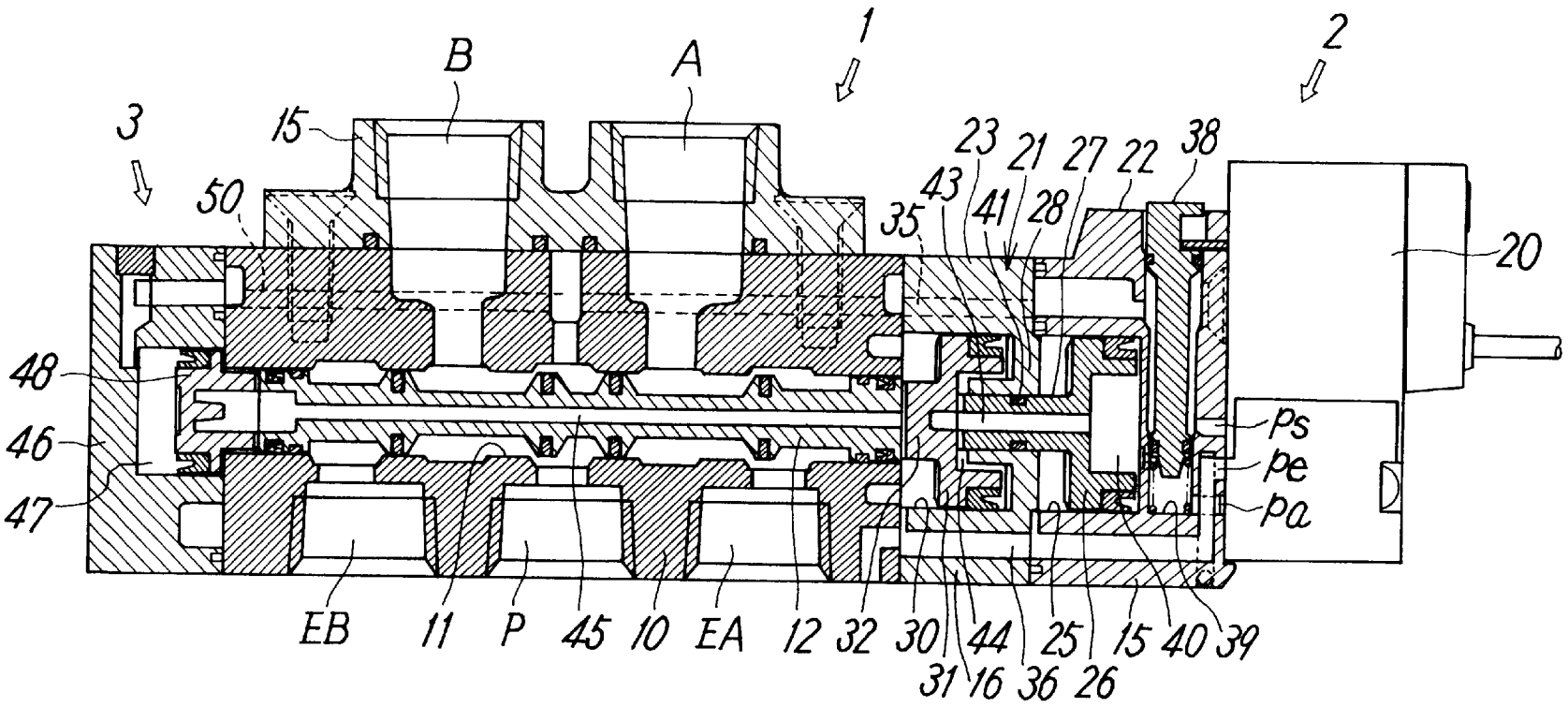
FIG. 1 and FIG. 1A are sectional views showing a structure of a first embodiment of a servo driving pilot-type solenoid valve according to the present invention.
Figure 1A:
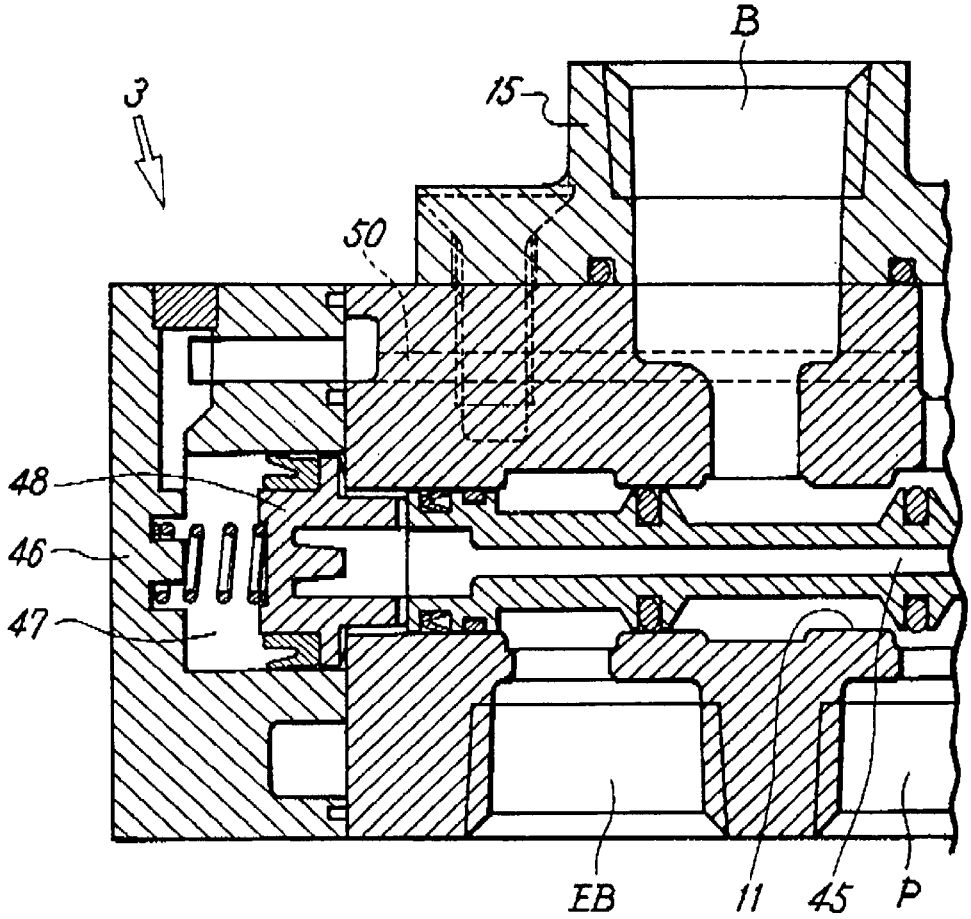

FIGS. 1 and 1A shows a structure of a first embodiment of a servo driving pilot-type solenoid valve according to the present invention. The servo driving pilot-type solenoid valve of the first embodiment comprises a main valve portion 1 for switching a main fluid such as compressed air, a pilot driving mechanism 2 for switching the main valve portion 1 by controlling a pilot fluid, and a returning mechanism 3 for returning the main valve portion 1.

The main valve portion 1 includes a valve body 10. A supply port P, output ports A and B, discharge port EA and EB, and a valve hole 11 to which these ports are opened are formed in the valve body 10. A spool-type flow path switching member 12 is axially slidably inserted into the valve hole 11. The output ports A and B output through a pipe joint 15 provided on the valve body 10, but the present invention should not be limited to this structure.

The pilot driving mechanism 2 includes one pilot valve 20 of solenoid driving type, and applies the pilot fluid pressure from the pilot valve 20 to a pushing member 21 which pushes one end of the valve member 12 to switch the valve member 12. On the other hand, the returning mechanism 3 applies a returning force by a fluid pressure to the other end of the valve member 12 independently of the pilot driving mechanism 2. Therefore, the valve member 12 is switched by the pilot driving mechanism 2 and the returning mechanism 3 such that the valve member 12 occupies either one of two switching position at opposite ends of the valve hole 11. That is, this pilot-type solenoid valve is formed as a single solenoid valve, and a flowing direction of a fluid flowing between the ports is switched.

In the above pilot driving mechanism 2, first and second interposition blocks 22 and 23 are disposed between the pilot valve 20 and the valve body 10 of the main valve portion 1 such that the blocks 22 and 23 are superposed on each other. In one of the interposition blocks (first interposition block 22) located closer to the pilot valve 20, a cylinder portion 25 in which a first piston 26 slides is provided on the same axis as that of the valve hole 11. In the second interposition block 23 located closer to the valve body 10, a cylinder portion 30 in which a second piston 31 slides is provided on the same axis as that of the valve hole 11. These two pistons 26 and 31 constitute the above-described pushing member 21, and have the same diameters. The second interposition block 23 is provided with a partition wall 28 through which a shaft 27 of the first piston 26 passes. It is preferable that a diameter of the shaft 27 is equal to or smaller than ½ of a diameter of the first piston 26.

In the pilot valve 20, a portion of a main fluid from the supply port P is supplied to a supply port ps through a pilot supply path 35 which passes through the valve body 10, the second interposition block 23 and the first interposition block 22. The fluid from the supply port ps is output to an output port pa by the passage of electric current through the solenoid, and the fluid of the output port pa is discharged out through a discharge flow path 36 from a discharge port pe by cutting the electric current through the solenoid. A manual operating element 38 provided on the first interposition block 22 switches the pilot flow path by its pushing pressure for bringing the pilot supply path 35 into direct communication with a driving pressure chamber 40 of the piston 26. The pilot supply path 35 is brought into communication of the supply port ps of the pilot valve 20 through a fitting hole 39 of the manual operating element 38, and a flow path for bringing the output port pa into communication with the driving pressure chamber 40 is also formed such as to pass a portion of the fitting hole 39 separated from the pilot supply path 35.

A driving side pressure chamber 40 formed in one side of the first piston 26 inserted into the cylinder portion 25 in the first interposition block 22 is connected to the output port pa in the pilot valve 20 as described above, and the pilot fluid pressure from the pilot valve 20 is applied to a pressure receiving surface closer to the pressure chamber 40. A chamber defined at the opposite side from the first piston 26 is in communication with the discharge flow path 36. The shaft 27 provided on the first piston 26 air-tightly passes through a partition wall 28 provided in the second interposition block 23 via a seal 41, a tip end of the shaft 27 abuts against the second piston 31, and a guide hole 43 for guiding the pilot fluid pressure in the pressure chamber 40 into the driving side pressure chamber 44 of the second piston 31 is formed in the first piston 26 and its shaft 27. The seal 41 is provided around the shaft 27 in the illustrated embodiment, the seal 41 may be provided around a cylindrical portion extending inward of the partition wall 28 of the first interposition block 22.

On the other hand, the second piston 31 inserted into the cylinder portion 30 in the second interposition block 23 is pushed by the shaft 27 of the first piston 26, and the second piston 31 itself also receives effect of the pilot fluid pressure introduced into the driving side pressure chamber 44 from the guide hole 43, and with these force, a pushing force for switching is applied to the valve member 12 through a pushing portion 32 projecting toward the valve member 12. A chamber formed in the cylinder portion 30 in the second interposition block 23 defined by the second piston 31 on the opposite side from the pressure chamber 44 is also in communication with the discharge flow path 36. A through hole 45 is formed in the center of the valve member 12 for bringing opposite ends of the valve member 12 into communication with the discharge flow path 36 through the chamber, so that a driving force by the fluid pressure is not generated in the valve member 12 itself.

In the returning mechanism 3, a returning pressure chamber 47 is formed in an end block 46 at the opposite end from the side in which the pilot driving mechanism 2 in the valve body 10 is provided, so that a returning force by the fluid pressure supplied to the returning pressure chamber 47 is always applied to the valve member 12 through a returning piston 48 independently of the pilot driving mechanism 2. For supplying the fluid pressure to the returning pressure chamber 47, a portion of the main fluid is supplied to the returning pressure chamber 47 from the supply port P in the valve body 10 through a fluid flow path 50 passing through the valve body 10.

It is preferable that a diameter of the returning piston 48 is set to $1/\sqrt{2}$ of that of the second piston 31 or an approximate value.

In addition to or in replace of the returning force by the above-described fluid pressure, a spring interposed between the end block 46 and the returning piston 48 can be used. In this case, a biasing force thereof is set in accordance with the above-described manner.

In the servo driving pilot-type solenoid valve having the above structure, if the pilot fluid pressure is supplied to the driving side pressure chamber 40 of the first piston 26 in the first interposition block 22 from the output port pa by driving the pilot valve 20, the first piston 26 is pushed by the fluid pressure and at the same time, since its fluid pressure is guided into the driving side pressure chamber 44 of the second piston 31 in the second interposition block 23 through the guide hole 43 in the shaft 27, the second piston 31 is also pushed by the fluid pressure. A force applied to the first piston 26 in this case is based on a pilot fluid pressure applied to an area obtained by subtracting a cross-sectional area of the shaft 27 from the total area of the pressure receiving surface closer to the driving side pressure chamber 40. A force directly applied from the pilot fluid pressure to the second piston 31 is based on a pilot fluid pressure applied to the total area of the pressure receiving surface of the second piston 31 closer to the driving side pressure chamber 44. If the supply of electric current to the pilot valve 20 is stopped, and the supply of pilot fluid pressure to the pressure chamber 40 is released, the valve member 12 is returned by a returning force based on the fluid pressure of the returning pressure chamber 47.

Since the shaft 27 of the first piston 26 abuts against the second piston 31, the first piston 26 pushes the second piston 31 through the shaft 27. Therefore, the sum of forces applied to the first piston 26 and the second piston 31 is applied to the valve member 12 so that the valve member 12 is driven by cooperation effect of the first and second pistons. As a result, the valve member 12 is pushed toward the end block 46 against the returning force by the fluid pressure always introduced into the returning pressure chamber 47 in the returning mechanism 3. By reducing the diameter of the shaft 27 to ½ or smaller of that of the first piston 26, the driving force is not to be lower than at least one and a half times of a case in which a single piston is provided.

When the first piston 26 and the second piston 31 are driven, the moving amounts of the first piston 26 and the second piston 31 can be set equal to each other, but the moving amounts need not to be the same, and strokes of both the pistons can be set appropriately, for example, after the first piston 26 may start moving, a tip end of the shaft 27 may abut against the second piston 31 and then, the shaft 27 may start pushing the second piston 31.

Therefore, a force by the pilot fluid pressure output from the pilot valve 20 can be increased by the first and second pistons to drive the valve member, switching of the valve member is reliably carried out, the valve member can be driven by the piston even if the pressure of the fluid is low and thus, it is possible to increase the driving pressure range.

In the pilot-type solenoid valve in the above embodiment, the first and second interposition blocks 22 and 23 are superposed on each other between the pilot valve 20 and the valve body 10, and the cylinder portions 25 and 30 on which the first and second pistons 26 and 31 slide are provided in these interposition blocks. The pilot-type solenoid valve of such a structure can use components common to general pilot-type solenoid valve except the first and second interposition blocks superposed between the pilot valve 20 and the valve body 10, as well as the first and second pistons and the like. The flow paths of the pilot valve are also common and therefore, the compatibility of the components is increased and the products can be produced inexpensively. Further, the servo driving pilot-type solenoid valve can be reduced in size like general pilot-type solenoid valve.

When this servo driving pilot-type solenoid valve is used as a general pilot-type solenoid valve, the second interposition block 23 is removed together with the second piston 31, the first piston 26 is replaced by a piston of the general pilot valve, and the first interposition block 22 is connected to the valve body.

Figure 2:
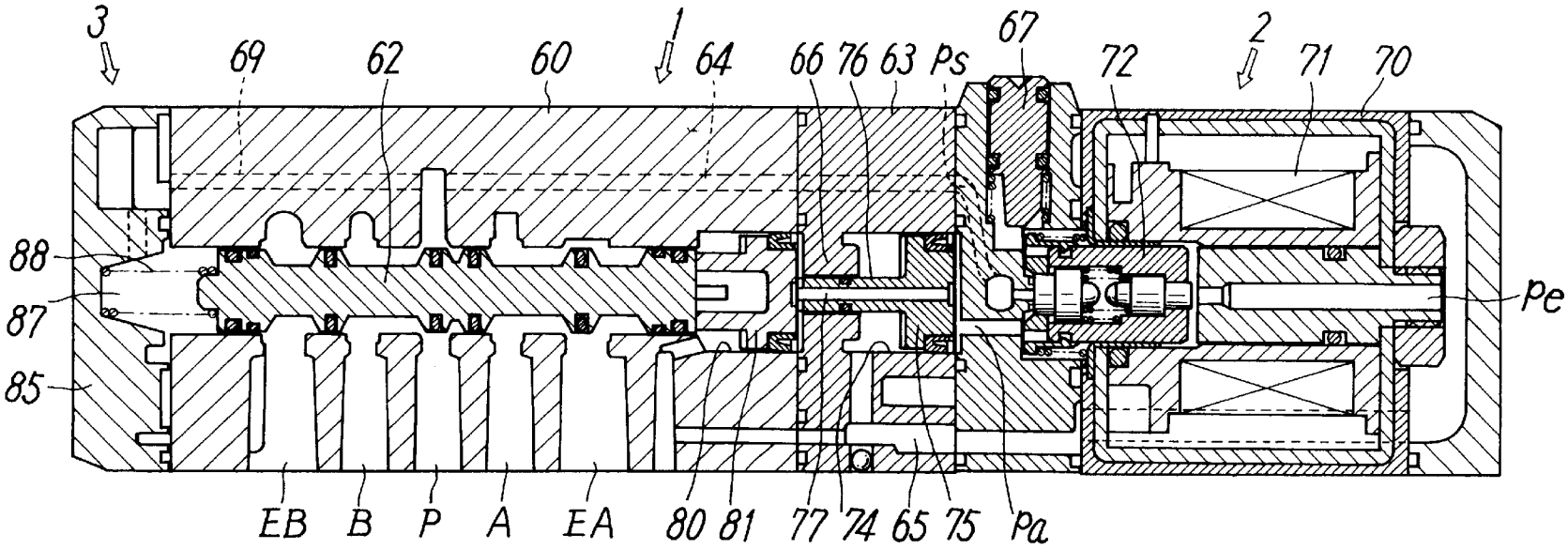
FIG. 2 is a sectional view showing a structure of a second embodiment of a servo driving pilot-type solenoid valve according to the invention.

FIG. 2 shows a second embodiment of a servo driving pilot-type solenoid valve of the present invention. The pilot-type solenoid valve of the second embodiment exhibits substantially the same function as that of the pilot-type solenoid valve of the first embodiment. Main differences are structure of the pilot valve, structure and disposition of the interposition block, an insertion position of the second piston, and structure of the returning mechanism 3. Therefore, only the differences will be explained below, and explanation of substantially the same structure and operation as those of the first embodiment will be omitted.

According to a pilot valve 70 of the pilot-type solenoid valve of the second embodiment, a portion of a main fluid is supplied from the supply port P of the main valve portion 1 to the supply port ps through a pilot supply path 64 passing through a valve body 60 and an interposition block 63. When electric current is supplied to a solenoid 71, a fluid is output from the supply port ps to the output port pa, and when the supply of electric current to the solenoid 71 is stopped, the fluid of the output port pa is discharged outside from the discharge port pe through a discharge flow path 65. A manual operating element 67 is provided in a body of the pilot valve 70 itself, and a movable core 72 in which a valve body of the pilot valve 70 is incorporated is pushed by pushing pressure of the manual operating element 67, thereby switching the flow paths.

A single interposition block 63 is provided between the pilot valve 70 and the valve body 60, a cylinder portion 74 on which a first piston 75 slides is provided in the interposition block 63, and a partition wall 66 through which a shaft 76 of the first piston 75 passes is provided. Further, a cylinder portion 80 on which the second piton 81 slides is formed in the valve body 60 closer to the pilot valve. The second embodiment is the same as the first embodiment in that the shaft 76 formed with a guide hole 77 of the first piston 75 passes through the partition wall 66, and a tip end of the shaft 76 abuts against the second piston 81.

In the returning mechanism 3 in the second embodiment, like the first embodiment, a returning pressure chamber 87 is formed in an end block 85 in the valve body 60, and a portion of a main fluid is supplied from the supply port P through the fluid flow path 69. A returning force by the fluid pressure supplied to the returning pressure chamber 87 is directly applied to the valve member 62 and in addition to this, a biasing force of a spring 88 interposed between the valve member 62 and the end block 85 is also applied to the valve member 62.

In the second embodiment, if the interposition block 63 is removed and the valve body 60 and the pilot valve 70 are directly connected to each other, this solenoid valve can be used as a general pilot-type solenoid valve. Therefore, as in the first embodiment, the compatibility with general pilot-type solenoid valves is increased, and the servo driving pilot-type solenoid valve can be reduced in size like general pilot-type solenoid valve.

According to the servo driving pilot-type solenoid valve of the present invention described above in detail, it is possible to obtain a servo driving pilot-type solenoid valve for driving a valve member by increasing a pilot fluid pressure output from a pilot valve so that valve member can reliably be switched. Therefore, a valve member can be driven even with a low pressure, thereby increasing a driving pressure range.

Further, according to the above-described servo driving pilot-type solenoid valve, compatibility with components of general pilot-type solenoid valve is increased, and the servo driving pilot-type solenoid valve can be reduced in size like the general pilot-type solenoid valve.

What is claimed is:

1. A servo driving pilot-type solenoid valve, comprising:

a main valve portion including a plurality of ports, a valve hole which is in communication with said ports, and a flow path switching valve member slidably inserted into said valve hole;

a pilot driving mechanism including a pushing member disposed in one end of said valve member, and a pilot valve for supplying a pilot fluid to said pushing member, said pilot driving mechanism switching said valve member by said pushing member which is operated by a pilot fluid pressure; and a returning mechanism for applying a returning force caused by at least one of a fluid pressure and a spring to the other end of said valve member, wherein, said pushing member in said pilot driving mechanism comprises, a first piston operated by the pilot fluid pressure from said pilot valve, and a second piston having substantially the same diameter as that of said first piston and operated by the pilot fluid pressure and a pushing force by said first piston, said first piston includes a shaft which air-tightly passes through a partition wall which divides both said pistons from each other and whose tip end abuts against said second piston, and a guide hole passing through said first piston and said first piston's shaft for guiding said pilot fluid pressure to a driving side pressure chamber of said second piston and, said second piston abuts against one end of said valve member and is operated by the operation force of the pilot fluid pressure introduced from said guide hole into a pressure chamber and by a pushing force of said first piston, thereby pushing said valve member.

2. A servo driving pilot-type solenoid valve according to claim 1, wherein first and second interposition blocks are connected to each other between said pilot valve and a valve body of said main valve portion, a cylinder portion on which said first piston slides is provided in said first interposition block located closer to said pilot valve, and said second interposition block located closer to said valve body is provided with said partition wall through which said shaft of said first piston passes, and with a cylinder portion on which said second piston slides.

3. A servo driving pilot-type solenoid valve according to claim 1, wherein one interposition block is provided between said pilot valve and a valve body of said main valve portion, said interposition block is provided therein with a cylinder portion on which said first piston slides and a partition wall through which said shaft of said first piston passes, and an end of said valve body of said main valve portion closer to said pilot valve is formed with a cylinder portion on which said second piston slides.

* * * * *